United States Patent [19]

Coelho

[11] Patent Number: 4,797,010

[45] Date of Patent: Jan. 10, 1989

[54] REHEATABLE, RESEALABLE PACKAGE FOR FRIED FOOD

[75] Inventor: Urban J. Coelho, Bedminster, N.J.

[73] Assignee: Nabisco Brands, Inc., Parsippany, N.J.

[21] Appl. No.: 101,001

[22] Filed: Sep. 22, 1987

[51] Int. Cl.[4] ..... B65B 25/06

[52] U.S. Cl. ..... 383/109; 383/113; 383/10; 383/78; 229/902; 426/113; 426/127

[58] Field of Search ..... 383/10, 109, 110, 113, 383/78, 84; 229/3.1, 902, 903; 426/113, 114, 127

[56] References Cited

U.S. PATENT DOCUMENTS

| | | | |
|---|---|---|---|
| Re. 28,887 | 6/1976 | Jack et al. | 162/66 |
| 2,157,392 | 5/1939 | Williams | 229/55 |
| 2,353,823 | 7/1944 | Hampel | 8/106 |
| 2,536,834 | 1/1951 | Baker et al. | 229/55 |
| 2,779,656 | 1/1957 | Fennell | 8/106 |
| 2,849,322 | 8/1958 | Brucker | 99/174 |
| 2,865,701 | 12/1958 | Schroeder | 8/106 |
| 3,027,066 | 3/1962 | Vineberg | 229/54 |
| 3,109,769 | 11/1963 | Martin | 162/164 |
| 3,112,985 | 12/1963 | Schoppmeyer et al. | 8/115.6 |
| 3,150,919 | 9/1964 | Lewin et al. | 8/115.6 |
| 3,203,623 | 8/1965 | Hartig | 229/62.5 |
| 3,212,697 | 10/1965 | Anderson | 229/57 |
| 3,256,138 | 6/1966 | Welch et al. | 162/124 |
| 3,271,239 | 9/1966 | Hornbostel, Jr. | 162/169 |
| 3,294,618 | 12/1966 | Busche et al. | 161/97 |
| 3,342,613 | 9/1967 | Schelhorn | 99/171 |
| 3,455,777 | 7/1969 | Goodwald | 162/78 |
| 3,475,199 | 10/1969 | Wolf | 117/92 |
| 3,501,374 | 3/1970 | Jack et al. | 162/89 |
| 3,507,443 | 4/1970 | Gerard | 229/55 |
| 3,637,000 | 1/1972 | Walger et al. | 150/3 |
| 3,707,438 | 12/1972 | Lincoln | 162/78 |
| 3,734,394 | 5/1973 | Dooley | 229/55 |
| 3,775,239 | 11/1973 | Snow | 161/250 |
| 3,916,030 | 10/1975 | Bard et al. | 426/113 |
| 4,172,152 | 10/1979 | Carlisle | 426/127 |
| 4,196,043 | 4/1980 | Singh | 162/30 K |
| 4,237,171 | 12/1980 | Laage et al. | 426/127 |
| 4,276,982 | 7/1981 | Sibrava et al. | 206/439 |
| 4,521,910 | 6/1985 | Keppel et al. | 383/10 |
| 4,550,442 | 10/1985 | Lepisto | 383/113 |
| 4,571,337 | 2/1986 | Cage et al. | 426/107 |
| 4,691,368 | 9/1987 | Roessiger | 383/10 |

FOREIGN PATENT DOCUMENTS

| | | | |
|---|---|---|---|
| 49-26082 | 7/1974 | Japan | 162/159 |
| 55-40720 | 10/1980 | Japan | 162/159 |
| 55-40719 | 10/1980 | Japan | 162/159 |
| 59-21799 | 2/1984 | Japan | 162/159 |
| 405058 | 7/1966 | Switzerland | 383/10 |
| 350925 | 6/1931 | United Kingdom . | |
| 1552810 | 9/1979 | United Kingdom . | |

*Primary Examiner*—Willis Little

*Attorney, Agent, or Firm*—Richard Kornutik

[57] ABSTRACT

A package for carrying, dispensing and reheating hot fried foods is disclosed. The package comprises an inner and an outer layer. The inner layer is a grease-absorbent layer and the outer layer is grease-resistant and flame retardant. The layers are preferably made from paper. The layers are connected only at two points, e.g., top and bottom, to provide for insulating, circulating air between the two-plies. The invention is able to insulate against loss of heat, allows for the venting of steam to prevent sogginess, absorbs grease on the inside to prevent sogginess, is grease resistant on the outside to prevent grease staining, has structural integrity and is cost effective. The invention is able to provide a reheating package for both microwave and conventional ovens.

18 Claims, 4 Drawing Sheets

REHEATABLE, RESEALABLE PACKAGE FOR FRIED FOOD

BACKGROUND OF THE INVENTION

1. Field of the Invention

This invention relates to flexible packages having consumer oriented diverse utility including cooking and heating. More particularly, the invention relates to flexible, multi-ply bags with venting or ventilation means, fluid circulating between bag piles, insulated and provided with a barrier ply. Also, the foods can be conventiently reheated using microwave or conventional ovens in the primary package itself.

2. Background Information

Problems exist in the packaging, dispensing and reheating of ready to eat hot foods. The problems are compounded with hot foods cooked in oils such as chicken, potatoes and the like. Packages used for dispensing hot fried foods should be able to insulate against loss of heat, for example chicken should be kept warm for about 30 minutes. Packages for fried foods should allow for the venting of stem to prevent sogginess. Packages should absorb grease on the inside to prevent sogginess yet be grease resistant on the outside to prevent grease staining. Furthermore, the package The current packages for such foods are cartons and buckets which are made of generally untreated paperboard. Grease coming from the products readily penetrates the board and the secondary paper bag package. The result is a very poor stained appearance showing a residue of grease on the surface where the package is placed.

The design of current cartons and buckets provides vents for the escape of steam from the chicken. However, thermal insulation properties are poor. The carry-out paper sack provides minimal insulation.

In terms of structural integrity, the buckets are adequately strong. However, the cartons show partial collapse after the grease and moisture have soaked into the board. The outer paper bag is awkward to carry.

Most of the current cartons have a rather poor autolock sealing feature and tend to open up when disturbed. The buckets do not experience this problem.

With the current system, the hot, fried foods have to be removed from the package for reheating.

U.S. Pat. No. 4,521,910 to Keppel discloses a multiwall cooler bag. The bag is formed by gussetted inner and outer tubes. The outer tube is made of Kraft paper and the inner tube is plastic material. No outer grease-resistant layer is disclosed.

U.S. Pat. No. 4,550,442 to Lepisto discloses a multiwall gussetted bag with seamless tubular liner. The liner is composed of a plastic material and therefore would not absorb grease as the present invention requires.

U.S. Pat. No. 4,172,152 to Carlisle discloses a thermally insulative beverage container. The carbonated beverage container has a gas permeable inner layer and a gas impermeable outer layer. The layers are made of plastic and will not absorb grease. Therefore the beverage container is not suitable for packaging fried chicken.

U.S. Pat. No. 3,734,394 to Dooley discloses a flexible package with double-layered walls. The walls are constructed from heat-sealable plastic and would not be able to absorb grease on the inside layer.

U.S. Pat. No. 3,637,000 to Walger et al. discloses a fire-resistant bag. Each ply of the multilayered bag includes heat-insulating material such as asbestos and a metal foil outer face. A grease-absorbing inner layer made of paper is not disclosed.

U.S. Pat. No. 3,203,623 to Hartig discloses multiwall valve bags. The inner layer has a moisture-resistant plastic coating which would not absorb grease.

U.S. Pat. No. 2,157,392 to Williams discloses a multiply paper bag. The inner layer is a Kraft paper and the outer layer is a 30-pound weight paper. The bag is stiffened with adhesive. An outer grease-resistant layer is not disclosed.

U.S. Pat. No. 4,571,337 to Cage et al. discloses a container and popcorn ingredient for microwave use. The two-ply bag has an outer layer of paper and an inner layer of non-wicking paper. A grease-absorbing inner layer made of paper is not disclosed.

U.S. Pat. No. 4,237,171 to Laage discloses an insulated and moisture-absorbent food container and method of manufacture. Hot foods are packaged in a box container having laminated walls. The inner layer is absorbent, porous, thick and rigid. The outer layer is foamed polystyrene for insulating and preventing moisture leakage. The device is expensive in contrast to a multi-layer bag which is not disclosed.

U.S. Pat. No. 3,916,030 to Bard et al. discloses heat-and-serve packages for meat products. A grease-resistant tray is folded over on itself to encase a meat product. The tray is then encased in a snugly drawn film. No inner absorbent layer is disclosed.

U.S. Pat. No. 3,775,239 to Snow discloses packaging material, packages and method of making same. The three-layer packaging sheet has a paper substrate layer, an extruded thin layer of a thermoplastic ionomer resin and an extruded layer of polyethylene. The layers are superimposed. An inexpensive insulating means such as an air layer between laminates is not disclosed.

U.S. Pat. No. 3,507,443 to Gerard discloses a ventilated multi-ply bag. The bag has an outer paper layer and a plastic impermeable layer. There is no inner absorbent layer and no outer grease-resistant layer as required for an effective package for hot fried foods.

U.S. Pat. No. 3,342,613 to Schelhorn discloses the construction of a blanket for moisture-pack poultry shipping system. An outer layer is plastic to which is bonded at spaced points an inner layer of moisture-absorbent material such as wet-strength bowling grade paper. The product is a wrapping and forms an airtight seal around the product to prevent dehydration and freezer burn. A layered material having an insulating layer of air located between inner and outer layers is not disclosed.

U.S. Pat. No. 3,212,697 to Anderson discloses a moisture-resistant paper sack. A carry-out sack has a lower portion of the interior coated and/or impregnated with a moisture- or water-repellant material. A two-ply paper bag wherein an inner ply is a kraft paper and an outer layer is grease-resistant paper is not disclosed.

U.S. Pat. No. 2,849,322 to Brucker discloses wrapping for meat products. The three-layer wrapping has an inner absorption layer and an outer grease-resistant layer with a water- and grease-resistant layer therebetween. A bag having an inner absorption layer and an outer grease-resistant layer, and air circulating therebetween for insulation is not disclosed.

U.S. Pat. No. 2,536,834 to Baker et al. discloses a ham packaging bag. A three-ply material is used wherein the innermost layer is grease-resistant, the middle layer is moisture absorbent and the outer layer is durable and contains printed matter. A two-ply material wherein the inner layer is absorbent and the outer layer is grease-resistant is not disclosed.

British Pat. No. 350,925 to Driver discloses waterproof and grease-proof wrappers, bags and other containers. Two sheets of paper are coated with paraffin wax and are then joined by their waxed sides and heated for adhesion. The outer surfaces are free from wax and the wax layer provides a moisture barrier. A two-ply bag having an inner absorption layer and an outer grease-resistant layer and an air layer in between is not disclosed.

British Pat. No. 1,552,810 to Artusi discloses a paper bag with liquid-holding container. A paper bag has an inner lining of blotting paper or paper felt and an intermediate layer of polyethylene. A bag having an inner layer of Kraft paper and an outer layer of grease-resistant paper with an air layer for insulation therebetween is not disclosed.

U.S. Pat. No. 3,027,066 to Vineberg discloses a bag handle structure. Aligned hand holes in the side walls wherein each is provided with surrounding support means is constructed on a typical paper or plastic bag. This patent is of general interest for showing handles on bags. A multiwalled bag is not disclosed.

U.S. Pat. No. 4,276,982 to Sibrava discloses a pressure-sensitive tape closure pouch. A bag closure having a flap which seals the opening adhesively is disclosed. This patent is of general interest for showing an adhesive closure for bags. Two-ply bags are not disclosed.

The present invention solves the problems associated with packages for hot fried foods. The present invention is a package used for dispensing hot fried foods which is able to insulate against loss of heat, for example, chicken can be kept warm for about 30 minutes. The present invention allows for the venting of steam to prevent sogginess. The present invention absorbs grease on the inside to prevent sogginess and is grease resistant on the outside to prevent grease staining. Moreover, the present invention has structural integrity and is cost effective. Furthermore, the present invention provides the convenience of reheating the contained foods in either microwave or conventional ovens.

SUMMARY OF THE INVENTION

The invention is a reheatable, resealable package for fried food. The package comprises an inner and an outer layer. The inner layer is a grease-absorbent layer and the outer layer is grease-resistant and flame retardant. The layers are preferably made from paper.

Both the inner and outer layer have front and rear opposed bag walls connected at the sides by opposed gussetted side walls and connected at the closed ends by overlapping bottom flaps. The outer layer encloses the inner layer. The outer layer is connected to the inner layer along the topmost edge near the opened end and is also connected by the adjacent bottoms of the layers. The layers are connected only at the two points to provide for insulating, circulating air between the two-plies.

Preferably the plies have a handle for carrying the package which is located near the opened end. The handle is preferably a die cut hole through the plies wherein the die cut provides a flap for threading through and folding around a hole on an opposed bag wall such that the open end is shut but still allows for venting of steam from hot, fried foods located within the package.

Alternatively, or in addition to the handle holes, the invention contemplates the use of non-continuous adhesive points for connecting the inside surfaces of the inner layer to close the opened end of the package. The non-continuous adhesive attachment provides for venting of steam from hot foods contained within the package to the areas which have no adhesive surfaces.

Both the inner and outer layer is preferably a bleached Kraft paper. The inner layer is grease-absorbent for pulling grease off of hot, fried foods such as chicken which is located within the bag to prevent undue sogginess occurring in the chicken after prolonged sitting within a package. Preferably, the outer layer is grease-proof and flame retardant paper. The outer layer is a barrier to the grease having been absorbed by the inner layer. The package may be carried about and laid upon surfaces without seepage of grease located on the hot, fried food located within the package.

The unique structure of the invention insulates the hot food from undue loss of heat and maintains the fried hot food hot without undue sogginess occurring for a considerable period of time.

Accordingly, it is an object of the invention to provide a package for hot, fried foods which prevents the foods from becoming unduly soggy by wicking-away the grease located on the goods.

It is another object of the invention to provide a package for hot, fried foods which will not allow grease to seep out of the package.

It is yet another object of the invention to provide a package which provides insulation for hot food located within the package by providing a layer of air between an inner and outer ply.

It is still another object of the invention to provide a package which allows for venting of steam from hot, fried foods located therein while preventing the food from becoming unduly soggy due to pooled grease within the bag and steam buildup.

It is another object of the invention to provide a package which serves as a cooking utensil for reheating the fried foods in either microwave or conventional ovens.

These and other further objects and features of the invention are apparent in the disclosure, which includes the foregoing and following specification, claims and drawings.

BRIEF DESCRIPTION OF THE DRAWINGS

While the specification concludes with claims particularly pointing out and distinctly claiming the subject matter that is regarded as forming the present invention, it is believed that the invention will be better understood from the following description accompanied by the following drawings in which:

DESCRIPTION OF THE PREFERRED EMBODIMENT

The best mode for carrying out the invention is disclosed in FIGS. 1 through 7.

Figure 1:
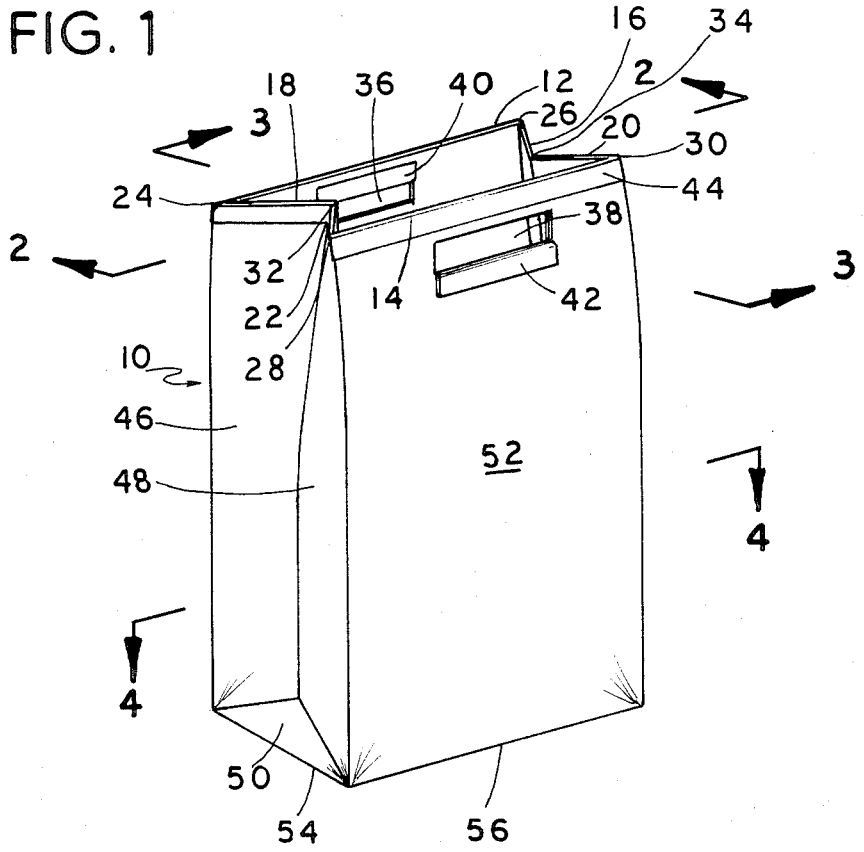
FIG. 1 is an elevated perspective of the invention.

Referring to FIG. 1, a bag 10 is shown having a gussetted side 46, 48 and 50. There is a front wall 52 having a bottom edge 56 and a top edge 14. The front wall 52 is opposed to a back wall 80 (shown in FIG. 3). On both the front and back walls there is located handle holes 38 and 36. Preferably, the handle holes are die cut on three edges to provide flaps 40 and 42 which may be folded. The top end of the bag 10 is closed by bringing corners 24, 28 and 26, 30 in adjacent proximity by pushing in inner corners of the gussets 32 and 34 thus collapsing inward the gusset edges 16, 20, 18 and 22.

When the opened end of the bag is closed, edges 12 and 14 are adjacent each other and the flaps 40 and 42 may be folded around the adjacent holes to hold the bag shut. The holes 38 and 36 provide an outlet for steam.

Figure 2:
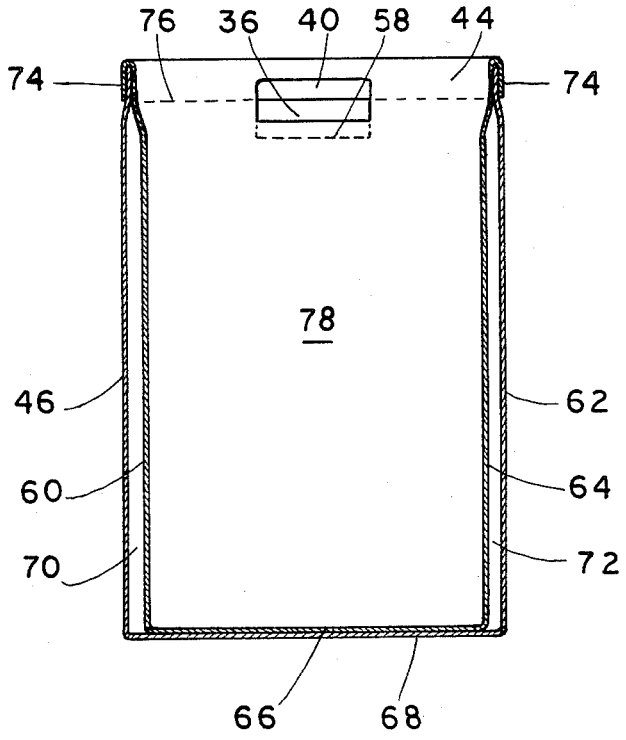
FIG. 2 is a plan view of a section of the invention disclosed in FIG. 1 taken along lines 2—2.

FIG. 2 shows the arrangement of the inner and outer plies. The inner bag wall in layer 78 is shown with the hole 36 and flap 40. The top edge 44 of inner lining 78 is folded over an outer layer at 74. The inner and outer layers are shown with separated edges 46 and 60 with space 70 for insulating air located therebetween. Also there is edge 62 and 64 with the space 72 located therebetween. The inner and outer layers are shown connected at the bottom of the sheet 78 by connecting adjacent bottom edges 66 and 68. The inner and outer layers are shown connected only at the bottom edges 66 and 68 and along the top edge 44. The connection of the layers at the top edge along the dotted line 76 provides a reinforcement and an upper part of the handle hole 36 for carrying a substantial load in the interior of the bag 10.

Figure 3:
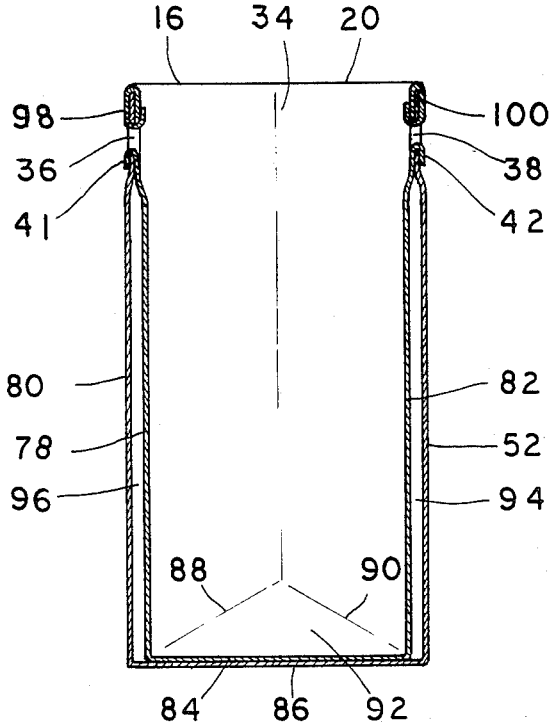
FIG. 3 is a plan view of a section of the invention disclosed in FIG. 1 taken along lines 3—3.

FIG. 3 is another view of the interior of the bag 10 shown on edge. The inner layers 78 and 82 are separated by a space 96 and 94 from the outer layers 80 and 52. As in FIG. 2, the inner layers are connected only at the bottoms 84 and 86 and along the topmost edges 98 and 100. Also in FIG. 3, the layers are shown connected at the holes 36 and 38 at points 41 and 42. Preferably the connection of the layers below the holes 36 and 38 is just at the holes and not continuous along a line drawn around the bag at a level equal with the lower end of the holes 36 and 38.

The gusset of the side wall of the bag is shown with fold lines 34, 88 and 90 folding inward.

Figure 4:
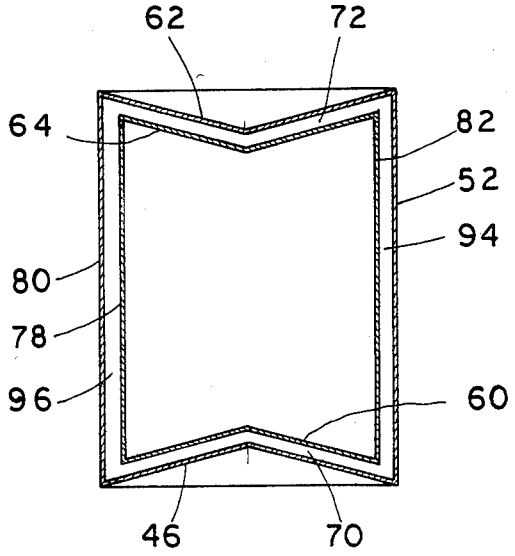
FIG. 4 is a top plan view of a section of the invention disclosed in FIG. 1 taken along lines 4—4.

FIG. 4 is another perspective of the invention. The space separating the inner layer from the outer layers is shown as completely surrounding the interior space of the bag. Thus, inner and outer layers 80 and 78 are separated by space 96. Inner and outer edges 52 and 82 are separated by space 94. Inner and outer edges 60 and 46 are separated by space 70. Inner and outer layers 64 and 62 are separated by space 72.

One of the key features of the invention is its insulating properties which is provided by the completely surrounding layer of air.

The invention provides for a takeout package which insulates against the loss of heat. For example, fried chicken can be kept warm for 30 minutes or more. The invention allows for the venting of steam to prevent a hot, fried product carried within the bag of the invention becoming soggy. The invention is grease-absorbent on the inside and grease-resistant on the outside to prevent the food product from becoming soggy and to prevent the grease within the bag from seeping out and staining the surroundings. The structral characteristics of the inner and outer layers i.e., the fact that they are only connected at the bottom and top together with the provision for handle holes provides the device with structural integrity. The fact that the invention is constructed from different types of paper makes the invention cost effective.

It is preferred that the style of the invention be a paper bag which can come in a variety of sizes depending upon the size of the load being carried thereby. It is preferred that the bags be self opening, duplexed, gussetted with overlapped, locked-tight automatic bottoms. It is preferred that the inner layers of the bag which are visible in FIG. 4 and shown to be opposed bag walls 78, 82, 80, 52 be connected by opposed gussetted side walls 60 and 64 and 62 and 46. It is preferred that the inner layer be constructed from #40 MG Kraft paper. It is preferred that the outer layer be constructed from #40 grease proof flame retardant paper.

The construction of Kraft paper is well known. In the Kraft process, pulping process wood chips are treated with a solution of sodium hydroxide and sodium sulfide which attacks the non-fibrous (lignin) portion of the wood so the individual fibers can be separated. (U.S. Pat. No. 4,196,043 to Singh, which is hereby incorporated by reference in its entirety, discloses this subject matter at column 1, lines 29–42.)

The bleaching of Kraft pulp for producing white paper is well known. U.S. Pat. No. 3,501,374 and U.S. Pat. No. Re. 28,887 to Jack et al., incorporated herein by reference in their entirety, discuss sequential bleaching of Kraft pulp with chlorine. U.S. Pat. No. 2,865,701 to Schroeder, incorporated herein by reference in its entirety, discusses a process of bleaching Kraft pulp with alkaline hypochlorite bleach. The pulp is acidified wherein the residual contains chlorine. The pulp is then bleached with alkaline peroxide. U.S. Pat. No. 3,455,777 to Goodwald, incorporated herein by reference in its entirety, discusses a method of bleaching Kraft pulp sheet. The Kraft pulp is contacted in sheet form with aqueous hypochlorite at a temperature of 100 to about 250 degrees Centigrade. U.S. Pat. No. 3,707,438 to Lincoln et al., incorporated herein by reference in its entirety, discusses a method for the brightening of Kraft pulp with tertiary butyl hydroperoxide. U.S. Pat. No. 2,779,656 to Fennel, incorporated herein by reference in its entirety, discusses a multistage process for bleaching Kraft pulp with active chlorine agents. U.S. Pat. No. 2,353,823 to Hampel, incorporated herein by reference in its entirety, discusses bleaching cellulosic materials with an aqueous solution containing a chlorite of the alkali metals, a persulfate of the alkali metals and alkaline earth metals at a pH of about 3–11.

The invention provides a package for reheating fried foods in a microwave. Therefore, it is preferred to use flame retardant Kraft paper in the construction of the invention. Flame retardant Kraft paper is well known. Japanese publication No. 55-40720 to Matsushita, incorporated herein by reference in its entirety, discusses flame retardant Kraft paper which is made by reacting Kraft paper or pulp with dibromocresyl glycidyl-ether. Japanese reference No. 59-21799 to Osaka Packing, incorporated herein by reference in its entirety, discloses a flame retardant paper which has calcium silicate, sepiolite, attapulgite, and palygorskite. Japanese reference No. 55-40719 to Matsushita, incorporated herein by reference in its entirety, discloses a Kraft paper or Kraft pulp which is reacted with dibromocresylglycidylether in the presence of a basic catalyst or acid catalyst and physical treatment, where powder of antimony trioxide, zinc borate and barium mataborate are mixed in the Kraft paper or Kraft pulp. Japanese reference No. 49-26082 to Koh-Jin Co., incorporated herein by reference in its entirety, discloses a flame retardant paper which is produced by (i) forming a dispersion of a powder-form material, selected from chlorinated polypropylene, chlorinated paraffin or chlorinated rubber, in a solution of sizing agent, (ii) adding the suspension in combination with $Sb_2O_3$ to a pulp solution, and (iii) forming a paper from the solution. U.S. Pat. No. 3,150,919 to Lewin et al., incorporated herein by reference in its entirety, discusses fireproofing lignocellulosic structures with bromine and chlorine solutions. U.S. Pat. No. 1,353,823 to Wolf, incorporated herein by reference in its entirety, discloses using hexamethyl tetramine in a fire retardant coating.

The invention provides for an outer Kraft paper layer which is grease proof to prevent grease from seeping from the inside to the outside. Grease proofing paper is well known. U.S. Pat. No. 3,109,769 to Martin, incorporated herein by reference in its entirety, discloses a process for incorporating resins into paper. Thermo-setting resins are incorporated into the pulp to provide greaseproofness. Such resins include vinyl derivatives, ethylenic resins, rosin and related compounds, natural resins, chlorinated diphenols, cellulose esters and ethers, natural and synthetic rubbers, phenolic resins in the novalac stage. U.S. Pat. No. 3,112,985 to Schoppmeyer et al., incorporated herein by reference in its entirety, discloses a method manufacturing packaging materials. A water vapor impervious resinous coating in a soft, flowable state is applied to one surface of a web of parchmentizable paper whereupon the coating is bonded without substantial penetration of the resin into the web. The resin may be polyethylene, polypropylene, polyvinylchloride, polyvinylidene chloride, polyamide, polycarbonate or polystyrene. U.S. Pat. No. 3,256,138 to Welch et al., incorporated herein by reference in its entirety, discloses application of polyethylene resin particles to a wet fibrous ply in forming a multi-ply water-laid web. U.S. Pat. No. 3,271,239 to Hornbostel, Jr., incorporated herein by reference in its entirety, discloses a process of forming a water-laid fibrous particle containing a polyalkaline resin. Polyethylene resin is added to the pulp prior to the formation of the paper. U.S. Pat. No. 3,294,618 to Busche et al., incorporated herein by reference in its entirety, discloses a paper having incorporated therein an impervious resin film. Resins useful for incorporation into the paper are polyethylene, polypropylene, nylon, fluorhalocarbons, polycarbonate and epoxy.

The treatment of the bleached Kraft paper for greaseproofing and flame retarding should not alter the appearance of the paper. The inner layer and the outer layer of the invention should appear to be the same to the casual onlooker.

Figure 6:
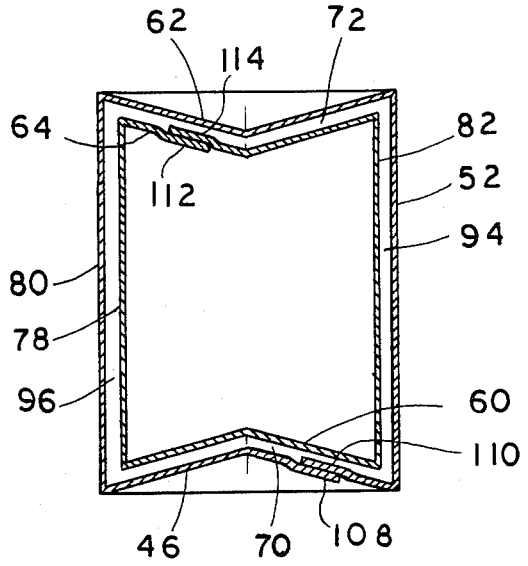
FIG. 6 is an another view of FIG. 4, showing placement of seams.

FIG. 6, illustrates a preferred location for the seams of the inner and outer layers. Preferably, the inner and outer layers have their seams located in the gusset areas. Inner surface 64 has overlapping ends 112 and 114. Similarly, outer surface 46 has overlapping ends 108 and 110. The overlapping ends are attached by using a well known adhesive.

The invention provides for three types of closures for the bag. The die cut handles provide for folding flaps which can hold the opposed sides adjacent. Additionally, dots of cohesive areas on the inside of the bag or strips of tape may be used to further hold the bag in a closed configuration.

The inner plane of the duplex bag of the invention absorbs most of the grease and moisture released by such foods as fried chicken, french fries, etc. The grease-resistant outer ply remains stainless. The invention can be further carried out by the use of a polyethylene outer bag into which the duplex paper bag of the present invention may be placed, to further provide grease resistance of the total package.

The sealing feature of the inventive bag allows the package to vent steam by way of gussets while providing thermal insulation. The air gap between the two plies of paper serves as an insulating medium. When utilized, the auxiliary, the polyethylene carryout bag will add to the insulating properties of the total package.

Figure 7:
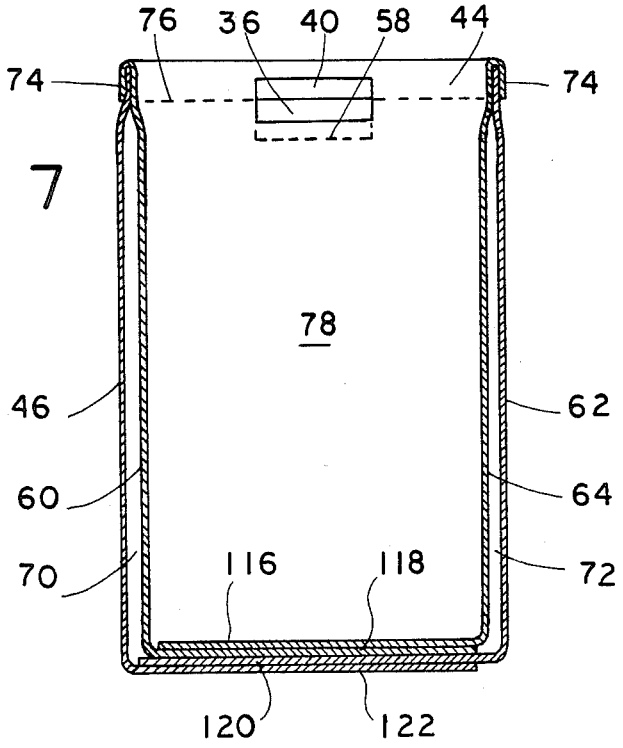
FIG. 7 is an another view of FIG. 2, showing the structure of the package bottom.

The duplex paper bag has good structural integrity and can stand on its bottom. Referring to FIG. 7, the bottom of the bag is shown. Inner bag bottom flaps 116 and 118 are show overlapping one another. The outer bag bottom flaps 120 and 122 are shown overlapping one another. The flaps 116, 118, 120 and 122 are attached to one another with an adhesive to provide a lock-tight bottom.

All three sealing features perform adequately. The invention provides for a device which can be reheated in the paper bag of the invention in both microwave and conventional ovens.

Figure 5:
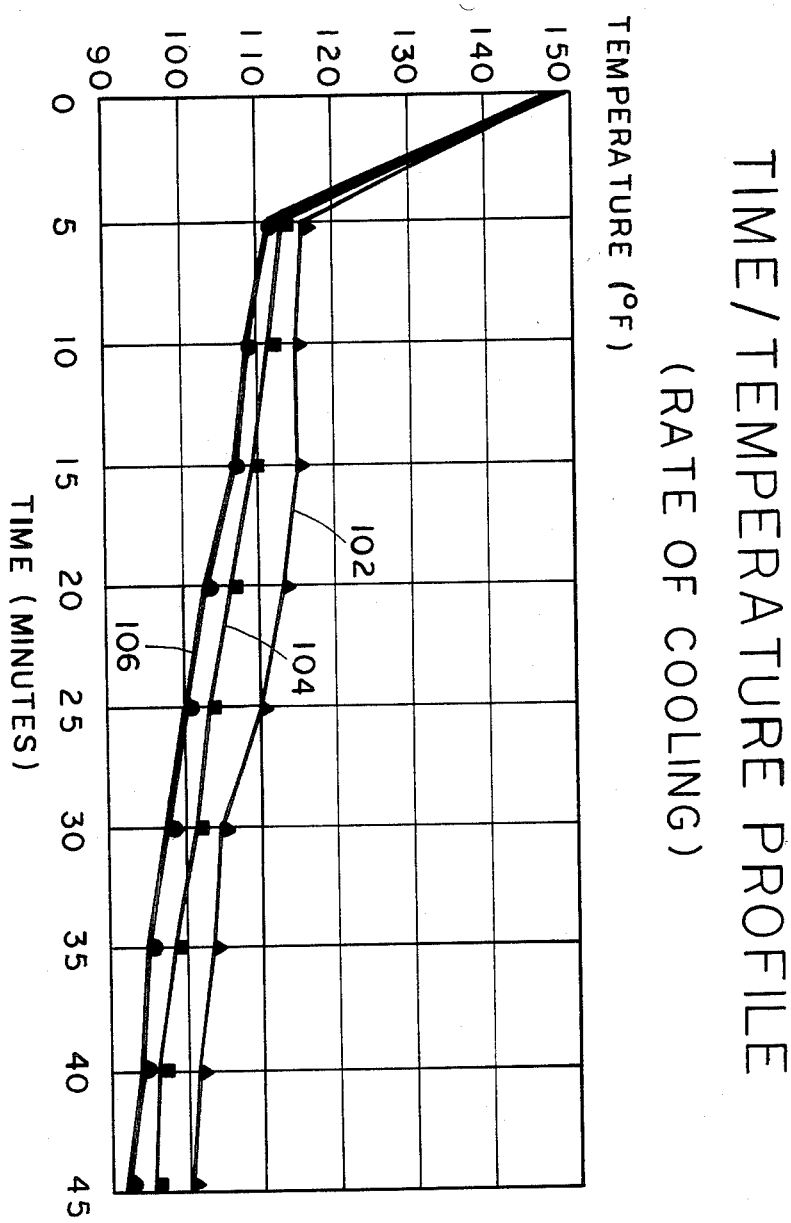
FIG. 5 is a graphical depiction of data showing the rate of cooling of an object stored within the invention.

FIG. 5 is a graphical depiction of a cool down temperature profile. The uppermost graph line 102 represents the cooling profile of the package according to the invention. The middle line 104 is the cooling profile of a foamed polystyrene material readily available in the market place. The bottom line 106 is a cooling profile of a current paperboard folding carton such as is currently being used for packaging hot, fried fast foods.

In all three cases the cooling profile is related to hot, fried chicken placed within the bag. The surface temperature of the chicken prior to packing was 150° F. The ambient air temperature surrounding the bag is 75° F.

It is readily apparent from viewing the graph that a duplex paper bag designed according to the invention insulates products more efficiently than current methods of packing hot, fried food products and does so much more cheaply.

As this invention may be embodied in several forms without departing from the spirit or central characteristics thereof, the present embodiment is therefore illustrative and not restrictive, and since the scope of the invention is defined by the appended claims, all changes that fall within the metes and bounds of the claims or that form their functional as well as their conjointly cooperative equivalents are therefore intended to be embraced by those claims.

What I claim is:

1. A reheatable, resealable package for fried food, comprising:

(a) an inner grease-absorbent paper layer, wherein said layer is in the shape of a bag having a closed end, an opened end and edges about the opened end;

(b) an outer grease-resistant layer, wherein said layer is in the shape of a bag having a closed end, an opened end and an edge about the opened end, wherein said outer layer encloses said inner layer, wherein said layers are connected at the edges about the opened ends and at the closed ends, whereby a layer of insulating air located between the connected edges and the connected closed ends forms between the layers.

2. The device of claim 1 wherein said layers have front and rear opposed bag walls connected at the sides by opposed gussetted side walls and connected at the closed ends by overlapping bottom flaps.

3. The device of claim 2 further comprising a hole in each bag wall near the opened ends, said holes being die cuts of said walls, wherein said die cuts provide a foldable flap for adjoining the bag walls at the opened ends by folding a flap through each wall.

4. The device of claim 2 further comprising non-continuous contact adhesive points on inside surfaces of the bag walls of the inner layer near the opened ends for closing the opened end with a non-continuous seal, whereby steam from hot, fried foods contained within the package is vented.

5. The device of claim 2 wherein said inner layer is constructed from #40 LB bleached Kraft paper.

6. The device of claim 5 wherein said outer layer is constructed from grease proof flame retardant Kraft paper.

7. A reheatable, resealable package for fried food, comprising:

(a) a first ply constructed from a grease-absorbent paper, wherein said first ply forms an inner layer of a bag and has opposed front and rear walls connected by opposed gussetted side walls and overlapping fixedly connected bottom flaps, whereby a opened end is provided;

(b) a second ply constructed from a grease-resistant paper, wherein said second ply forms an outer layer of a bag and has opposed front and rear walls connected by opposed gussetted side walls and overlapping fixedly connected bottom flaps, whereby an opened end is provided, wherein said second ply has located therein said first ply, wherein said second ply is substantially coextensive with said first ply, and wherein said plies are fixedly connected along said opened ends and along said bottom flaps, whereby a layer of insulating air is maintained between the plies.

8. The device of claim 7 further comprising a hole in each bag wall near the opened ends, said holes being die cuts of said walls, wherein said die cuts have a foldable flap for adjoining the bag walls at the opened ends by folding a flap through each hole, whereby steam generated from hot foods contained within the package can be vented out said holes when the walls are adjoined.

9. The device of claim 8 further comprising non-continuous contact adhesive points on inside surfaces of the bag walls of the inner layer near the opened ends for closing the opened end with a non-continuous seal, whereby steam from hot, fried foods contained within the package is vented.

10. The device of claim 9 wherein said inner layer is constructed from #40 LB bleached Kraft paper.

11. The device of claim 10 wherein said outer layer is constructed from grease proof flame retardant Kraft paper.

12. A reheatable, resealable package for fried food, comprising:

(a) a first ply constructed from a grease-absorbent paper, wherein said first ply forms an inner layer of a bag and has opposed front and rear walls connected by opposed gussetted side walls and overlapping fixedly connected bottom flaps, whereby a opened end is provided;

(b) a second ply constructed from a grease-resistant paper, wherein said second ply forms an outer layer of a bag and has opposed front and rear walls connected by opposed gussetted side walls and overlapping fixedly connected bottom flaps, whereby an opened end is provided, wherein said second ply has located therein said first ply, wherein said second ply is substantially coextensive with said first ply, and wherein said plies are fixedly connected along said opened ends and along said bottom flaps, whereby a layer of insulating air is maintained between the plies;

(c) a hole in each bag wall near the opened ends, said holes being die cuts of said walls, wherein said die cuts have a foldable flap for adjoining the bag walls at the opened ends by folding a flap through each hole, whereby steam generated from hot foods contained within the package can be vented out said holes when the walls are adjoined.

13. The device of claim 12 further comprising non-continuous contact adhesive points on inside surfaces of the bag walls of the inner layer near the opened ends for closing the opened end with a non-continuous seal, whereby steam from hot, fried foods contained within the package is vented.

14. The device of claim 13 wherein said inner layer is constructed from #40 LB bleached Kraft paper.

15. The device of claim 14 wherein said outer layer is constructed from grease proof flame retardant Kraft paper.

16. The device of claim 15 wherein the contact adhesive points are sections of recloseable adhesive tape.

17. A reheatable, resealable package for fried food, comprising:

an inner grease-absorbent paper layer, wherein said layer is in the shape of a bag having a closed end, an opened end and edges about the opened end;

an outer grease-resistant layer, wherein said layer is in the shape of a bag having a closed end, and opened end and an edge about the opened end, wherein said outer layer encloses said inner layer, wherein said layers are connected at the edges about the opened ends and at the closed ends, whereby a layer of insulating air located between the connected edges and the connected closed ends forms between the layers;

said inner and outer layers having front and rear opposed bag walls connected at the sides by opposed gusseted side walls and connected at the closed ends by overlapping bottom flaps;

said front and rear bag walls each having a hole disposed therein near the opened end of said layers, said holes being die cuts of said side walls, wherein said die cuts provide a foldable flap for adjoining the bag walls at the opened ends by folding a flap through each wall;

said front and rear bag walls further including a plurality of non-continuous contact adhesive points disposed on the inside surfaces of said inner layer of said bag walls near the opened ends for closing the opened end with a non-continuous seal, whereby steam from hot, fried foods contained within the package is vented.

18. A reheatable, resealable package for fried food, comprising:

(a) first ply constructed from #40 LB bleached Kraft paper, wherein said first ply forms an inner layer of a bag and has opposed front and rear walls connected by opposed gusseted side walls and overlapping fixedly connected bottom flaps, whereby an opened end is provided;

(b) a second ply constructed from greaseproof, flame retardant Kraft paper, wherein said second ply forms an outer layer of a bag and has opposed front and rear walls connected by opposed gusseted side walls and overlapping fixedly connnected bottom flaps, whereby an opened end is provided, wherein said second ply has located therein said first ply, wherein said second ply is substantially coextensive with said first ply, and wherein said plies are fixedly connected along said opened ends and along said bottom flaps, whereby a layer of insulating air is maintained between the plies;

(c) a hole in each bag wall near the opened ends, said holes being die cuts of said walls, wherein said die cuts have a foldable flap for adjoining the bag walls at the opened ends by folding a flap through each hole, whereby steam generated from hot foods contained within thr package can be vented out said holes when the walls are adjoined;

(d) a plurality of non-continuous sections of recloseable adhesive tape disposed on the inside surfaces of the inner layer of the bag walls near the opened ends for closing the opened end with a non-continuous seal, whereby steam from hot, fried foods contained within the package is vented.

* * * * *